US006471122B1

(12) United States Patent
Stewart et al.

(10) Patent No.: US 6,471,122 B1
(45) Date of Patent: Oct. 29, 2002

(54) PAPERBOARD CAN WITH AN INTEGRATED PAPERBOARD LID HAVING A SLIDE CLOSURE

(75) Inventors: Noel G. Stewart; L. David Fielder, both of Oxford, GA (US); Angela Lueders Rowland, Collegeville, PA (US); Suzanne Theresa Barker, St. Louis Park, MN (US); David Lawrence Botterman, Arlington, TX (US)

(73) Assignee: Stone Container Corporation, Chicago, IL (US)

( * ) Notice: Subject to any disclaimer, the term of this patent is extended or adjusted under 35 U.S.C. 154(b) by 0 days.

(21) Appl. No.: 09/586,451

(22) Filed: Jun. 2, 2000

Related U.S. Application Data

(63) Continuation-in-part of application No. 09/437,968, filed on Nov. 10, 1999.
(60) Provisional application No. 60/120,030, filed on Feb. 13, 1999.

(51) Int. Cl.[7] ..... B65D 43/16; B65D 17/00
(52) U.S. Cl. ..... 229/125.09; 229/220; 220/620
(58) Field of Search ..... 220/345.4, 620; 229/125.09, 220; 222/541.6, 541.5

(56) References Cited

U.S. PATENT DOCUMENTS

| | | | | |
|---|---|---|---|---|
| 1,305,630 A | | 6/1919 | Swerdfeger | |
| 1,431,561 A | | 10/1922 | Blain | |
| 1,773,553 A | | 8/1930 | Taylor et al. | |
| 1,884,545 A | | 10/1932 | Boutin | |
| 1,951,274 A | | 3/1934 | Denman | |
| 1,961,055 A | | 5/1934 | Lewin | |
| 2,108,431 A | | 2/1938 | Cornwall | |
| 2,120,904 A | | 6/1938 | Moore | |
| 2,141,011 A | | 12/1938 | Monk | |
| 2,146,226 A | | 2/1939 | Punte | |
| 2,152,400 A | | 3/1939 | Rold | |
| 2,162,999 A | * | 6/1939 | Frank | 220/345.4 X |
| 2,179,231 A | | 11/1939 | Moore | |
| 2,285,067 A | * | 6/1942 | Thompson | 229/125.16 |
| 2,431,744 A | | 12/1947 | Fessenden | |
| 2,719,663 A | | 10/1955 | Meyer-Jagenberg | |
| 2,802,613 A | | 8/1957 | Boyd | |
| 2,808,194 A | | 10/1957 | Dols | |
| 2,847,151 A | | 8/1958 | Meyer-Jagenberg | |
| 2,923,445 A | | 2/1960 | Klausmann | |
| 2,931,554 A | | 4/1960 | Matern | |
| 3,026,013 A | | 3/1962 | Ullrich et al. | |

(List continued on next page.)

FOREIGN PATENT DOCUMENTS

| | | |
|---|---|---|
| EP | 0 540 923 A1 | 11/1992 |
| EP | 0 611 703 B1 | 5/1997 |
| FR | 2695625 A1 | 9/1992 |
| GB | 393 199 | 6/1933 |

*Primary Examiner*—Lee Young
*Assistant Examiner*—Tri M. Mai
(74) *Attorney, Agent, or Firm*—Dick and Harris

(57) ABSTRACT

A paperboard container for releasably dispensing contents contained therein is convertible from a substantially sealed orientation to a substantially open, dispensing orientation and back to the substantially sealed orientation. The container comprises a tubular body member, a bottom member and a top member, with the top member being telescopically received within the body member to seal the top member to the body member. The top member has a closure member that is repositionable to the sealed orientation to substantially reseal the container member.

13 Claims, 11 Drawing Sheets

U.S. PATENT DOCUMENTS 3,090,542 A 5/1963 Miller
3,127,082 A 3/1964 Meyer-Jagenberg
3,180,552 A 4/1965 Atkinson
3,302,858 A 2/1967 Miller
3,334,797 A 8/1967 Latham et al.
3,370,104 A * 2/1968 O'Brien et al. ..... 220/620 X
3,373,916 A 3/1968 Montagano
3,391,852 A 7/1968 Waldrop
3,648,919 A 3/1972 Anderson
3,893,566 A 7/1975 Ross
3,900,155 A 8/1975 Rausing et al.
3,973,719 A 8/1976 Johnson et al.
4,094,456 A 6/1978 Raccaforte
4,127,212 A * 11/1978 Waterbury ..... 220/345.4 X
4,280,653 A 7/1981 Elias
4,308,956 A 1/1982 Steinke et al.
4,312,450 A 1/1982 Reil
4,401,229 A 8/1983 Bell et al.
4,433,808 A 2/1984 Gordon et al.
4,491,252 A 1/1985 Schmidt et al.
4,579,246 A 4/1986 Swearinger et al.
4,583,679 A 4/1986 Johnson
4,673,126 A 6/1987 Hambleton
4,715,528 A 12/1987 Kjelgaard et al.
4,768,703 A 9/1988 Sosler et al.
4,771,936 A 9/1988 Dolby
4,909,395 A 3/1990 Weissman
4,913,292 A 4/1990 Field
4,930,682 A 6/1990 Gordon et al.
4,953,707 A 9/1990 Wein
4,998,668 A 3/1991 Rausing
5,002,222 A 3/1991 Giblin
5,014,888 A 5/1991 Bryan
5,027,999 A 7/1991 Kücherer
5,044,503 A 9/1991 Wein
5,067,615 A 11/1991 Davitian
5,080,233 A 1/1992 Wyberg
5,135,159 A 8/1992 Giblin et al.
5,141,150 A 8/1992 Plaessmann
5,400,914 A 3/1995 Lin
5,647,500 A 7/1997 Konno et al.
5,772,060 A 6/1998 Kaneko et al.
5,806,757 A 9/1998 Per et al.

* cited by examiner

FIG. 4
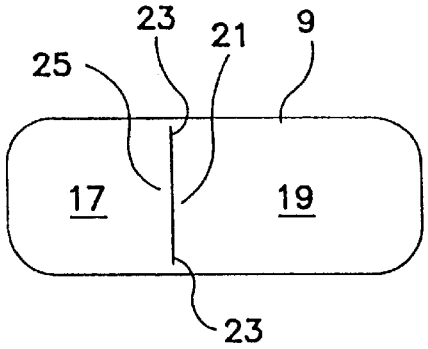
FIG. 5A
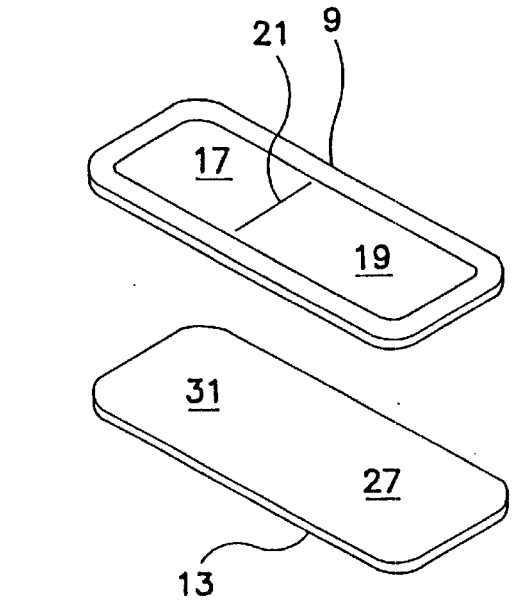
FIG. 5B
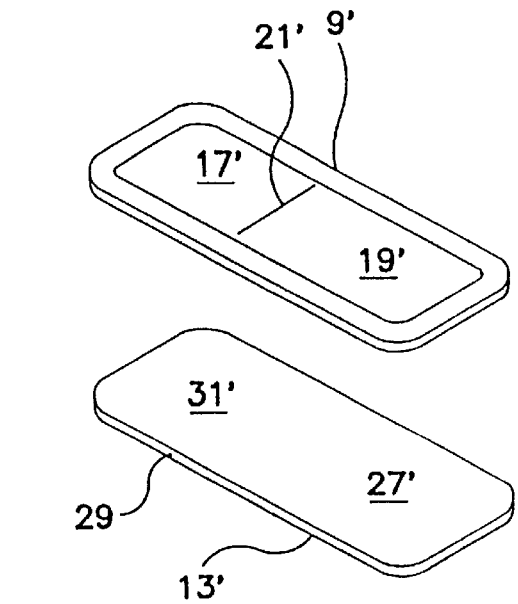
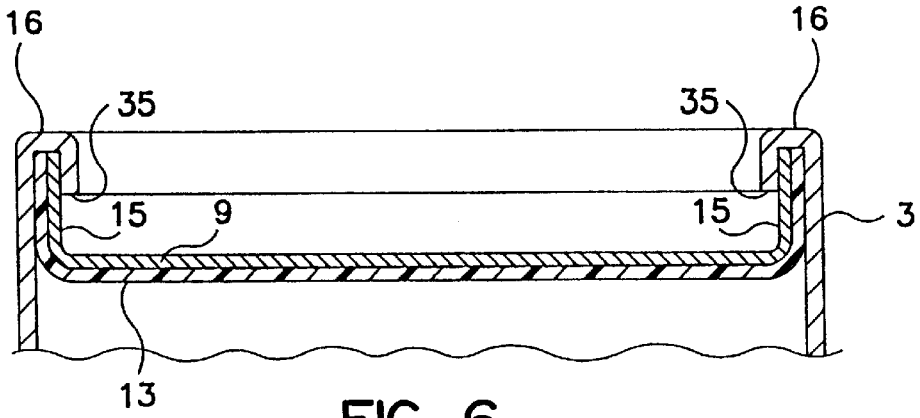
FIG. 6

FIG. 16A
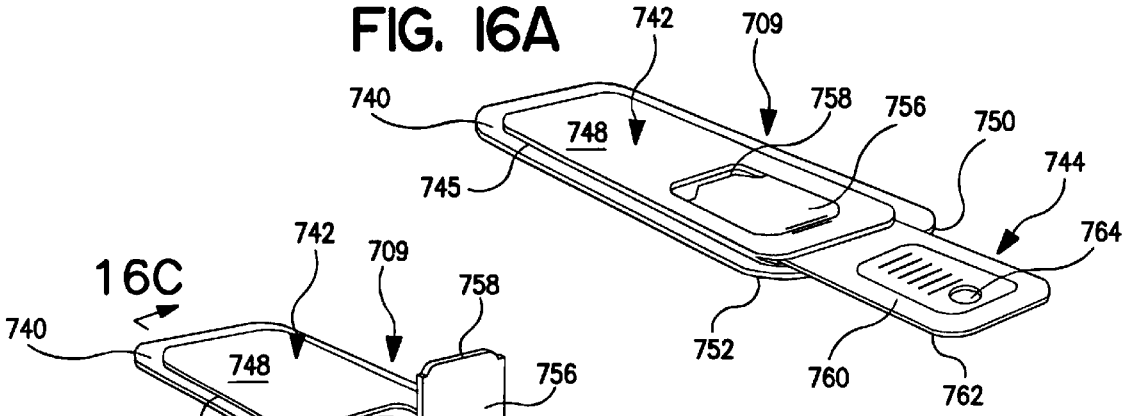
FIG. 16B
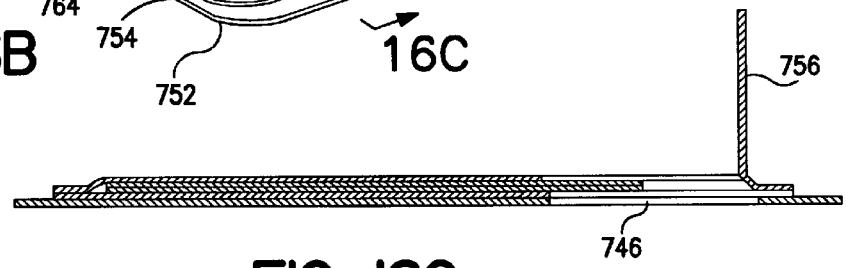
FIG. 16C
FIG. 17A
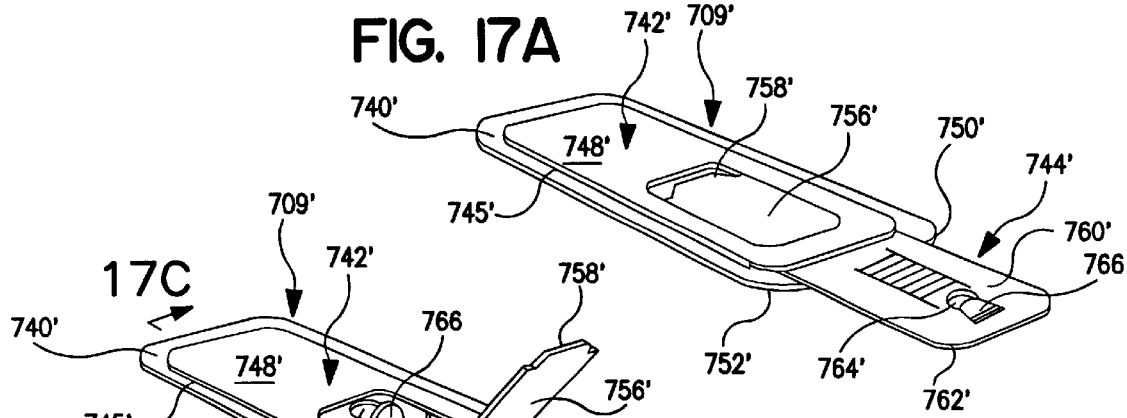
FIG. 17B
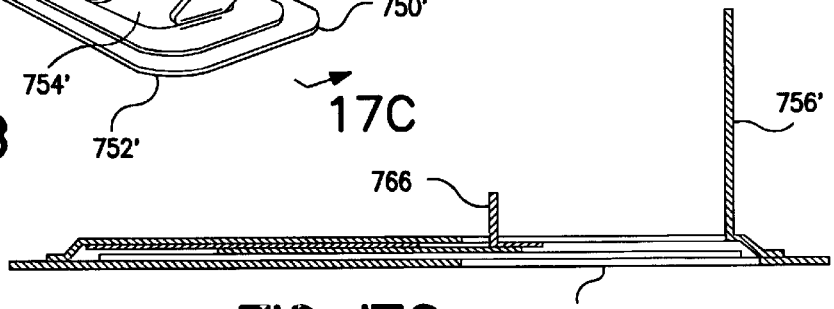
FIG. 17C

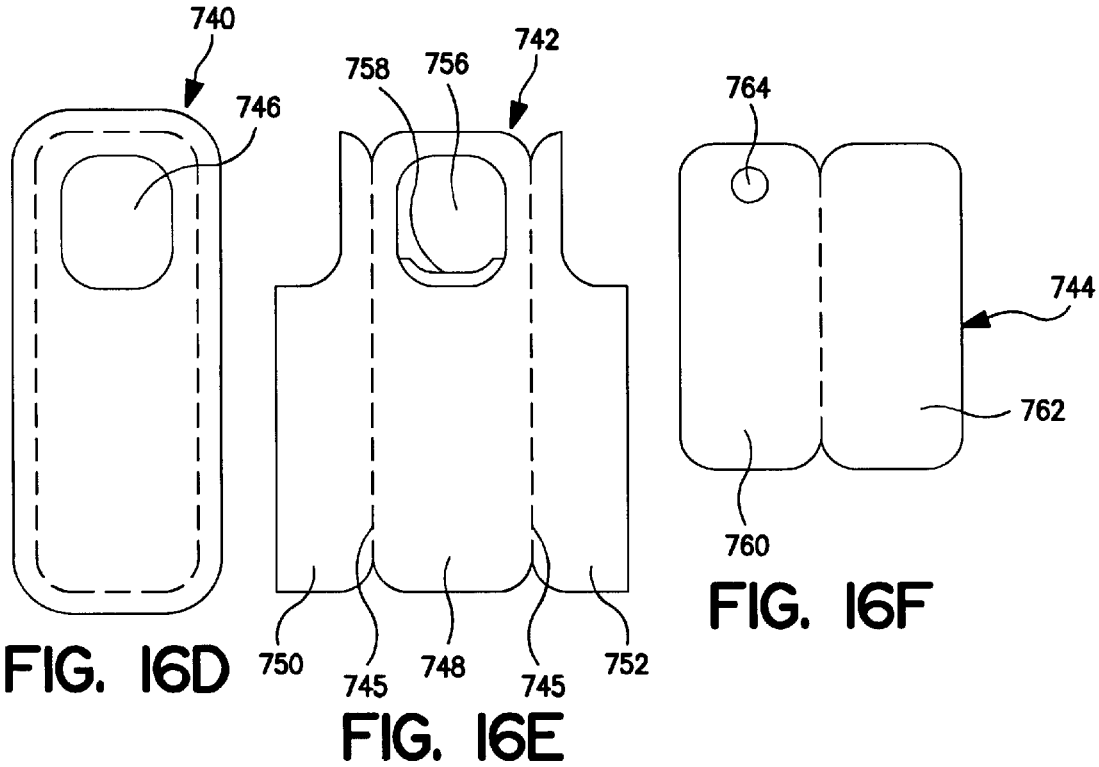
FIG. 16D
FIG. 16E
FIG. 16F
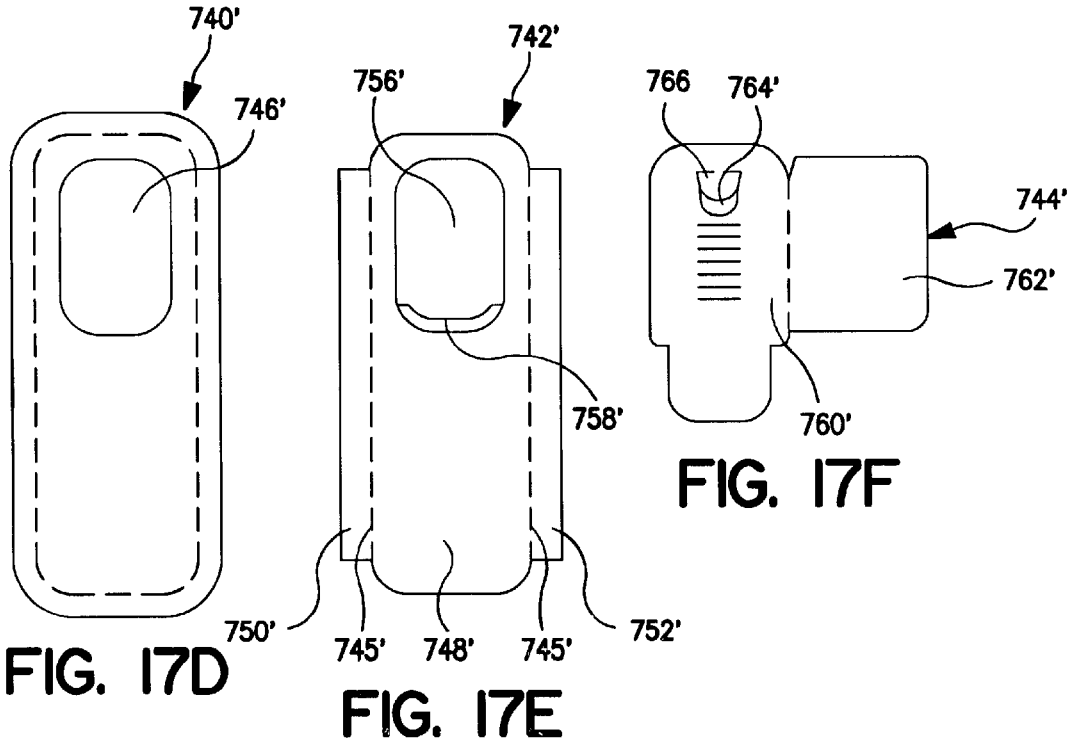
FIG. 17D
FIG. 17E
FIG. 17F

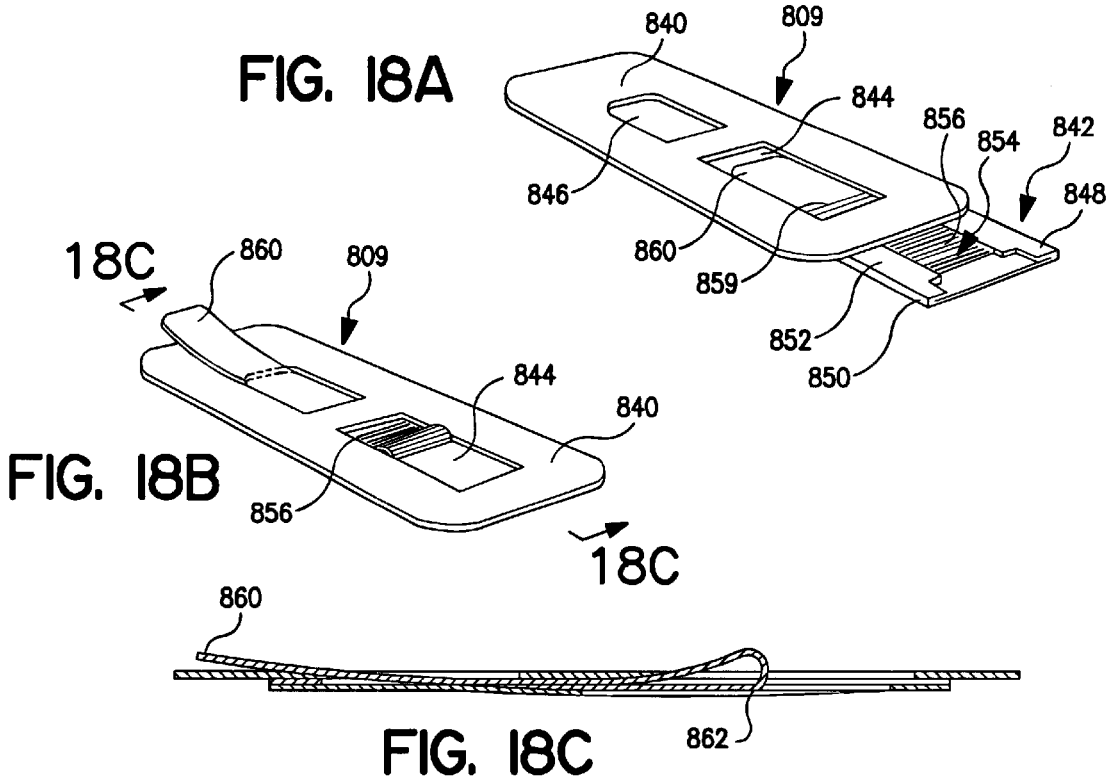
FIG. 18A
FIG. 18B
FIG. 18C
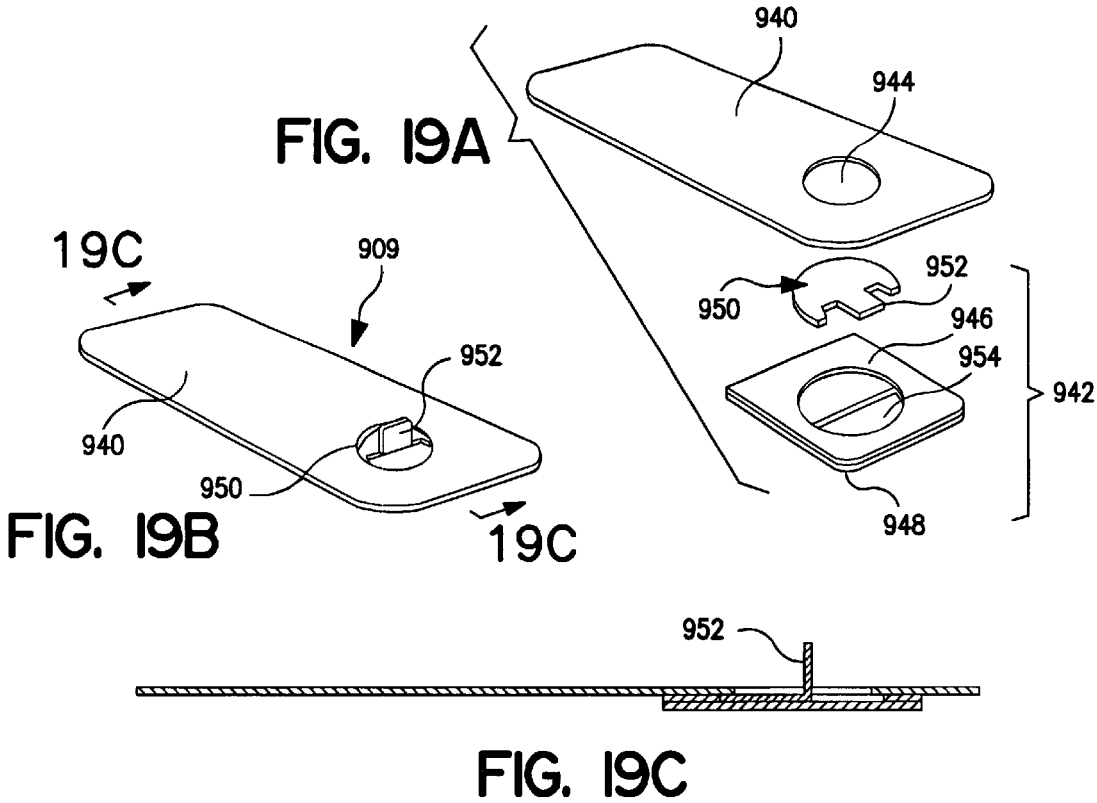
FIG. 19A
FIG. 19B
FIG. 19C

PAPERBOARD CAN WITH AN INTEGRATED PAPERBOARD LID HAVING A SLIDE CLOSURE

CROSS-REFERENCE TO RELATED APPLICATIONS

This application is a continuation-in-part of and claims the benefit of U.S. patent application Ser. No. 09/437,968, filed Nov. 10, 1999, which, in turn, claims priority of U.S. Provisional Application No. 60/120,030, filed Feb. 13, 1999.

STATEMENT REGARDING FEDERALLY SPONSORED RESEARCH OR DEVELOPMENT

Not Applicable.

REFERENCE TO A "MICROFICHE APPENDIX"

Not Applicable.

BACKGROUND OF THE DISCLOSURE

1. Field of the Invention

The present invention is directed to paperboard lids for paperboard containers and, more specifically, to an integrated paperboard lid having a slide closure.

2. Background Art

Paper containers are often used to hold consumer items such as cereals, grains, etc. To open the container, often, the consumer simply opens the entire top of the container. This allows access to the inner liner that holds the products. This arrangement is typical of boxes of breakfast cereal. Other boxes include a perforated portion on the side of the box, near the top, or on the top of the box, near the side. The perforated portion, when separated from the box, creates an openable flap that allows access to the interior of the box. This type of construction, which is often found on boxes of grain, soap and other products, usually, does not allow for effective closing of the box.

It would be desirable to provide a container that is convertible from a substantially sealed orientation to a substantially open, dispensing orientation and back to the substantially sealed orientation.

It would also be desirable to provide a container that is capable of remaining in a substantially open, dispensing orientation without obstructing the dispensing of contents contained therein.

It would also be desirable to provide a container that is capable of reclosing from a substantially open orientation to a substantially sealed orientation without the loss of contents contained therein.

These general characteristics of the present invention together with others, will become apparent in light of the present specification, claims and drawings.

SUMMARY OF THE INVENTION

The present invention is directed to a paperboard container for releasably dispensing contents contained therein, the container being convertible from a substantially sealed orientation to a substantially open, dispensing orientation and back to the substantially sealed orientation.

The paperboard container comprises a substantially tubular body member having an upper edge defining an upper opening. A bottom is affixed to the body member.

A top member substantially corresponds in shape to the shape of the upper opening. The top member has a lid panel extending across at least a portion of the upper opening of the tubular body, a support member mounted to the lid panel, a closure member connected to and movable relative to at least one of the lid panel and the support member, an outer edge having a peripheral shape, the peripheral shape being larger than the peripheral shape of each of the upper edge and the upper opening of the container member.

The top member is telescopically received within the upper opening of the container member, with the upper edge of the container member being rolled up over the outer edge of the top member to seal the top member to the paperboard container.

The closure member is movable from a sealed position to an open position in a plane substantially parallel to the lid panel. The top member is further repositionable to the sealed orientation to substantially reseal the container member.

In a preferred embodiment of the invention, the container includes a membrane adhered to inner surfaces of the container member below the container top member.

In one embodiment of the invention, the closure member moves from the first position to the second position in a substantially linear direction. In another embodiment of the invention, the closure member pivots about an axis substantially perpendicular to the lid panel axis.

The lid panel has an aperture, the closure member substantially covering the lid panel aperture in its substantially closed orientation.

In a preferred embodiment, the closure member may have an aperture, the closure member aperture allowing the container to be moved from the substantially sealed orientation to the substantially open, dispensing orientation and back to the substantially sealed orientation.

In a preferred embodiment, the support member includes an aperture, the support member aperture being coincident with the lid panel aperture upon attachment of the support member to the lid panel.

The closure member may include a tab member for positioning the closure member between the substantially sealed orientation and the substantially open, dispensing orientation.

The closure member may have a tongue and at least one protrusion, the tongue being capable of positioning the closure member between the substantially sealed orientation and the substantially open, dispensing orientation, the at least one protrusion restricting movement of the closure member within the support member.

In an alternative embodiment, the lid panel may extend substantially across the length of the upper opening of the tubular body and has an aperture extending therethrough, the closure member including a panel having a length substantially less than the length of the upper opening, and is positioned atop the lid panel and operably configured to slide therealong, from the sealed position over the aperture, to the open position longitudinally displaced relative thereto, and the support member being a flexible elongated tongue connected at one end thereof to an end of the closure member, and at another end thereof, to the lid panel, such that the support member rolls upon itself, as the closure member is moved from the sealed position to the open position.

In another alternative embodiment, the lid panel may extend across substantially less than the entire length of the upper opening of the tubular body and is affixed at one end of the length of the upper opening, the closure member including a panel having a length substantially less than the length of the upper opening, positioned atop the lid panel and operably configured to slide therealong, from the sealed position over the aperture, to the open position longitudinally displaced relative thereto, and the support member including a flexible elongated tongue connected at one end thereof to an end of the closure member, and at another end thereof, to an end of the lid panel, the support member further including a transverse fold line at a position substantially midway between its ends, and further including a tab member for grasping, such that upon grasping and upward pulling of the tab member, the support member folds upon itself, as the closure member is moved toward the lid panel, from the sealed position to the open position.

The closure member may alternatively include a twist lid for pivoting the closure member between the substantially sealed orientation and the substantially open, dispensing orientation. The twist lid may be semi-circular.

BRIEF DESCRIPTION OF THE DRAWINGS

FIG. 1 is a perspective view of a container of the present invention, with the container being closed;

FIG. 3 is an exploded view of the container of FIG. 1;

FIG. 4 is a plan view of a blank from which the lid of FIG. 1 is made;

FIG. 5*a* is a perspective, exploded view of an alternative blank from which he lid is made, this lid including a laminated underside;

FIG. 5*b* is a perspective, exploded view of an alternative blank from which he lid is made, this lid also including a laminated underside;

FIG. 6 is a cross-sectional view taken along lines 6—6 of FIG. 1, and looking in the direction of the arrows, showing the lid of FIG. 5 used to cover the container;

FIG. 16*a* is a perspective view of the blanks used to form yet another alternative lid, with the lid being closed;

FIG. 16*b* is a perspective view of the fully assembled lid of FIG. 16*a*, with the lid being open;

FIG. 16*c* is a cross-sectional view taken along lines 16*c*–16*c* of FIG. 16*b*, and looking in the direction of the arrows, showing the lid in its open position;

FIG. 16*d* is a top, plan view of a first blank used to form the alternative lid of FIGS. 16*a* and 16*b;*

FIG. 16*e* is a top, plan view of a second blank used to form the alternative lid of FIGS. 16*a* and 16*b;*

FIG. 16*f* is a top, plan view of a third blank used to form the alternative lid of FIGS. 16*a* and 16*b;*

FIG. 17*a* is a perspective view of the blanks used to form another alternative lid, with the lid being closed;

FIG. 17*b* is a perspective view of the fully assembled lid of FIG. 17*a*, with the lid being open;

FIG. 17*c* is a cross-sectional view taken along lines 17*c*—17*c* of FIG. 17*b*, and looking in the direction of the arrows, showing the lid in its open position;

FIG. 17*d* is a top, plan view of a first blank used to form the alternative lid of FIGS. 17*a* and 17*b;*

FIG. 17*e* is a top, plan view of a second blank used to form the alternative lid of FIGS. 17*a* and 17*b;*

FIG. 17*f* is a top, plan view of a third blank used to form the alternative lid of FIGS. 17*a* and 17*b;*

FIG. 18*a* is a perspective view of the blanks used to form another alternative lid, with the lid being closed;

FIG. 18*b* is a perspective view of the fully assembled lid of FIG. 18*a*, with the lid being open;

FIG. 18*c* is a cross-sectional view taken along lines 18*c*—18*c* of FIG. 18*b*, and looking in the direction of the arrows, showing the lid in its open position;

FIG. 19*a* is a perspective, exploded view of the blanks used to form yet another alternative lid;

FIG. 19*b* is a perspective view of the fully assembled lid of FIG. 19*a*, with the lid being open;

FIG. 19*c* is a cross-sectional view taken along lines 19*c*—19*c* of FIG. 19*b*, and looking in the direction of the arrows, showing the lid in its open position;

DETAILED DESCRIPTION OF THE DRAWINGS

Figure 2:
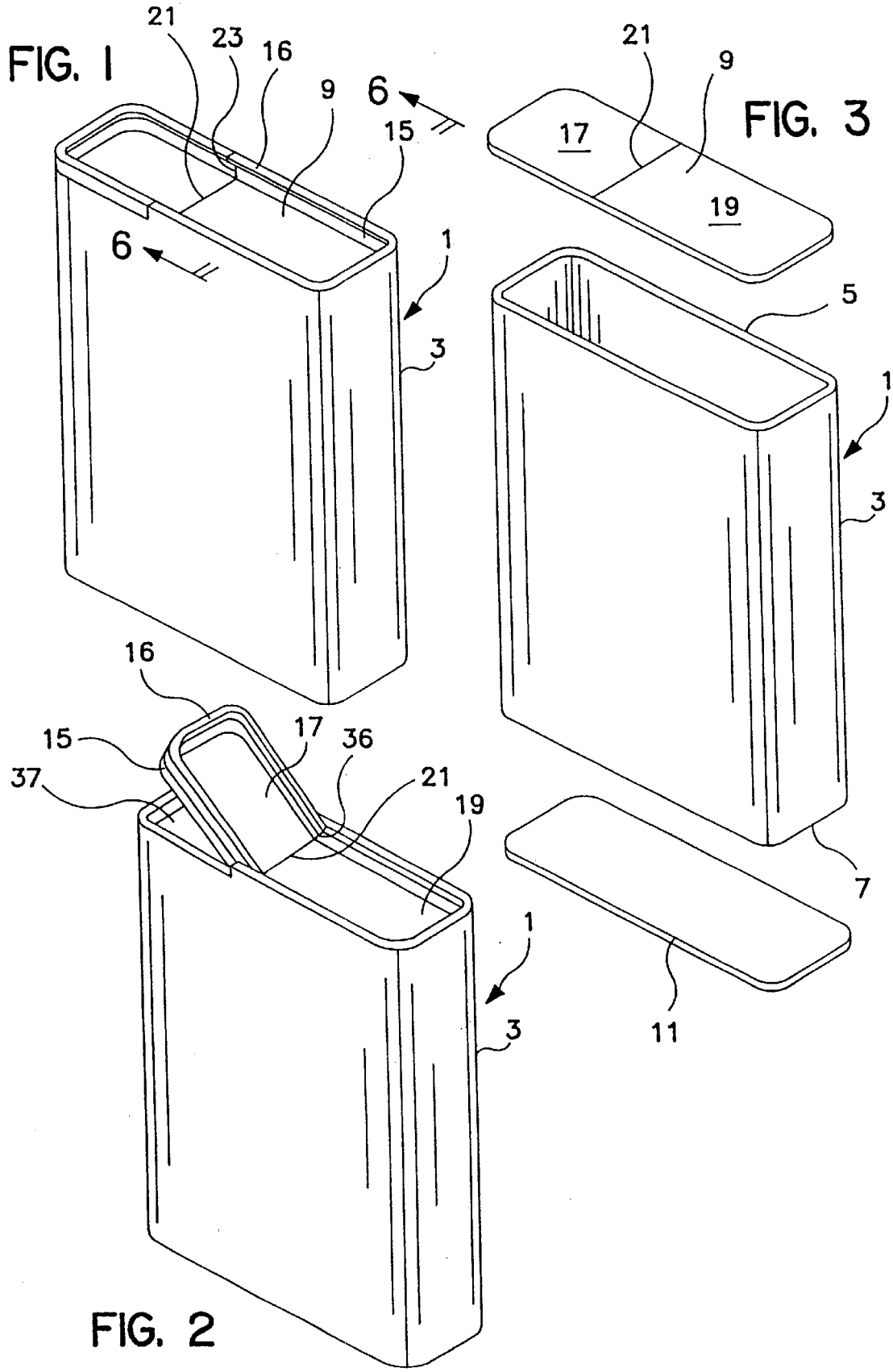
FIG. 2 is a perspective view showing the container of FIG. 1, with the lid open.

While this invention is susceptible of embodiment in many different forms, there are shown in the drawings and will be described in detail herein, several specific embodiments with the understanding that the present invention is to be considered as an exemplification of the principles of the invention and is not intended to limit the invention to the embodiments illustrated.

One embodiment of a paperboard container 1 of the present invention is shown generally in FIGS. 1–3. The container 1 includes a main body or tube portion 3 having a top edge 5 and a bottom edge 7. The body 3 has sidewalls 10 defining a chamber that is open at its top and bottom. The body 3 shown in the drawings is generally quadrilateral in plan view. However, the body could be circular, triangular, or any other desired shape. A top or cover, member 9 and a bottom member 11 are provided to close the top and bottom openings of the body 3. The top and bottom members 9 and 11 are, in this embodiment, the same shape and size, though in other embodiments they may be of different size. They are also generally in the same shape as the body 3, but are proportionally larger than the body 3. That is, the circumferences of the top and bottom members 9 and 11 are greater than the circumference of body 3.

The top member 9 can be a single ply. Alternatively, as seen in FIGS. 5*a* and 6, a laminate 13 can be applied to the bottom surface of the top member 9 to form a top member assembly. Likewise, as shown in FIG. 5*b*, a laminate 13' can be applied to the bottom surface of the top member 9' to form a top member assembly.

To apply the top and bottom members 9 and 11 to the body 3, the respective member is pressed into the body 3, as seen in FIG. 6. When the top or bottom member is pressed into the body 3, the peripheral edges 15 of the top or bottom member will be turned up (in the case of top members 9 and 9'). The member is pushed into the body until the outer edge of the top or bottom member is below the top (or above the bottom) edge of the body 3. The top edge 5 of the body 3 is then rolled over to form a lip 16 that extends around the circumference of container 1.

As seen in FIG. 4, the top member 9 includes a front portion 17 and a rear portion 19 separated by a line 21. The line 21 includes cuts, perforations, or other lines of weakness 23 that extend inwardly from the side edges of the top member 9. A fold line 25 then separates the lines of weakness 23. As seen in FIG. 1, the line 23 extends up the peripheral portion 15 of the top member 9.

As seen in FIG. 5*a*, in the top member 9, the laminate 13 has a back portion 27 having a side-to-side width substantially equal to the side-to-side width of the top member 9. The laminate back portion 27 is substantially as long as the top member rear portion 19, and extends from the back edge of the top member 9 to the line 21. As shown in FIG. 5*b*, at approximately line 21'; laminate 13' steps down, as at 29, to form the front portion 31' of laminate 13'. The laminate front portion 31' has a side-to-side width approximately equal to the side-to-side width of the body 3 (which is less than the side-to-side width of the top member 9').

Additionally, the laminate front portion 31' does not extend to the front edge of the top member 9'. Rather, it is sized to extend to the front edge of the body 3 when the top member assembly is placed in the body 3.

After the top member 9 is applied to the container body 3, a cut 24 (FIG. 1) is formed beneath the top edge 5 of the container 1. The cut 24 is positioned on the body 3 to be approximately equal with or slightly below the bottom of the lip 16 (i.e., the original top edge 5 of the body 3). The cut 24, however, is above the upper surface of the top member 9, as shown in FIG. 2. The cut 24 extends from a point co-linear with the top member line 21 around the front of the body 3 and back to a point co-linear with the top member line 21. The cut 24 enables the front portion 17 of the top member 9 to be lifted up, as shown in FIG. 2. As also shown in FIG. 2, when the cover front portion 17 is lifted to its opened position, the lower part of the lip 16 is exposed. Additionally, when the cover front portion 17 is opened, the rear edges 36 of the lip 16 are forced inside of the lip of the cover rear portion 19. The two portions create a friction fit that holds the cover front portion 17 in its opened position. Further, because the lip 16 is exposed below the cut 24, the lip 16 will frictionally engage the wall of the container body 3 when the cover front portion 17 is closed, as shown in FIG. 1. This will help retain the cover front portion 17 in its closed position.

As shown in FIG. 2, the container 1 can include a membrane or seal 37 below cover member 9. The seal 37 closes the container below the cover member 9 and must be broken before product can be poured from the container 1.

Figure 9:
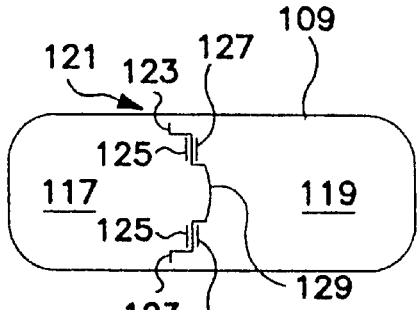
FIG. 9 is a plan view of a blank used to form the lid for the container of FIG. 7.

A second embodiment of the cover member is shown in FIGS. 7–10. The container 101 of FIGS. 7 and 8 may have a body 103 substantially identical in construction to the body 3 of container 1 of FIGS. 1 and 2. The cover member 109, in turn, is substantially similar to the cover member 9. The substantial difference lies in the line 121 FIG. 7 that separates the cover front portion 117 from the cover back portion 119. As shown in FIG. 9, the line 121 includes opposing outer cuts 123 which have outer ends spaced from the side edges of the cover member 109 and extend inwardly slightly. A second pair of opposing cuts 125 extend rearwardly (and orthogonally) from the inner edges of outer cuts 123. A pair of inner fold lines 127 extends inwardly from the ends of the second cut lines. Another pair of opposing cuts 128 extend rearwardly (and orthogonally) from the inner fold lines 127, and together with arcuate cut 129, form tab 130. The tab 130 is formed to extend toward the cover back portion 119.

Figure 7:
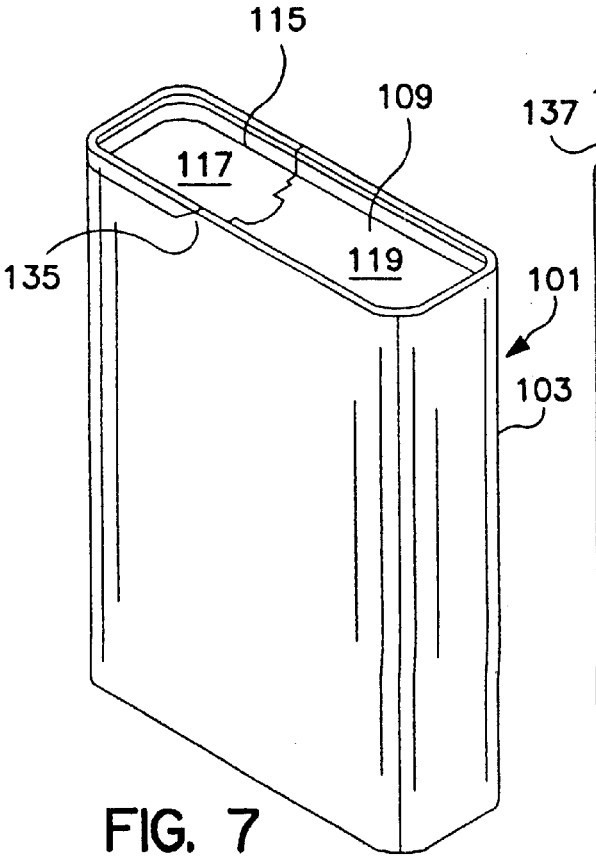
FIG. 7 is a perspective view of an alternative container, with an alternative lid construction, with the lid being closed.
Figure 8:
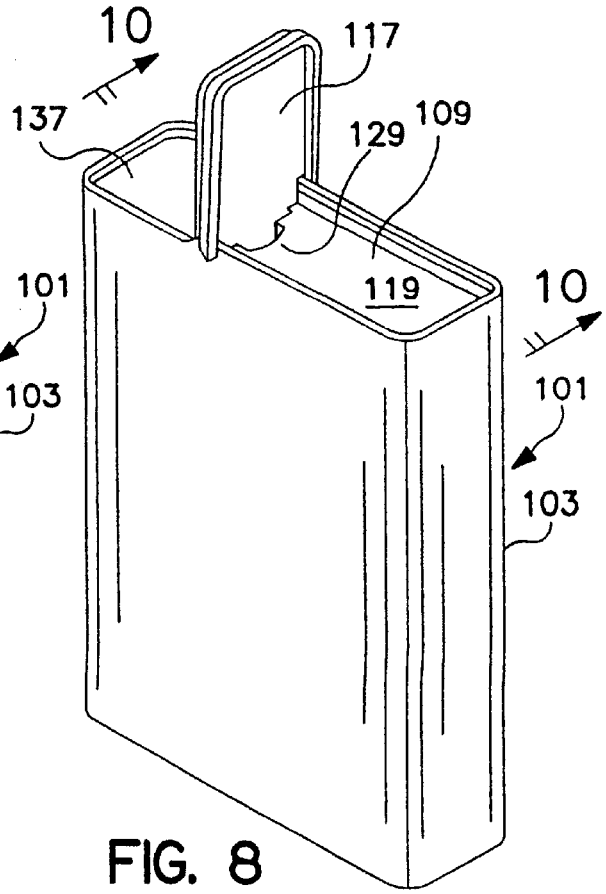
FIG. 8 is a perspective view of the container of FIG. 7, with the lid being open.
Figure 10:
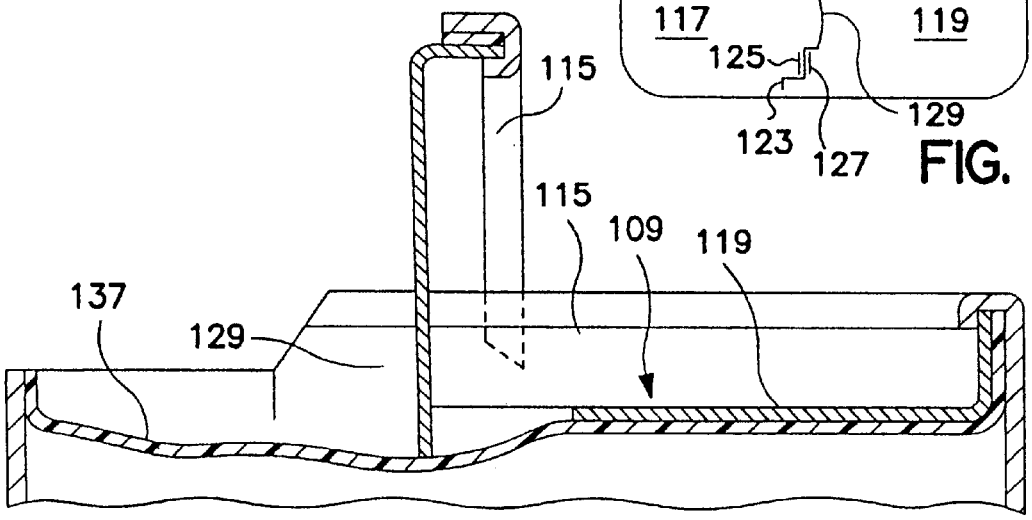
FIG. 10 is a cross-sectional view taken along lines 10—10 of FIG. 8, and looking in the direction of the arrows, showing the lid in its open position.
Figure 11A:
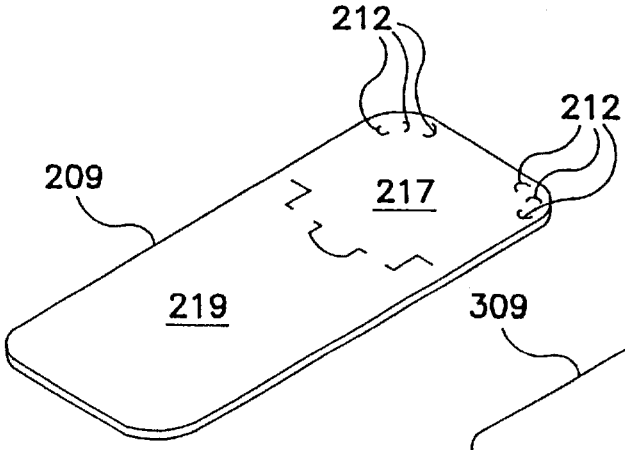
FIG. 11*a* is a perspective view of a blank used to form an alternative lid.
Figure 12A:
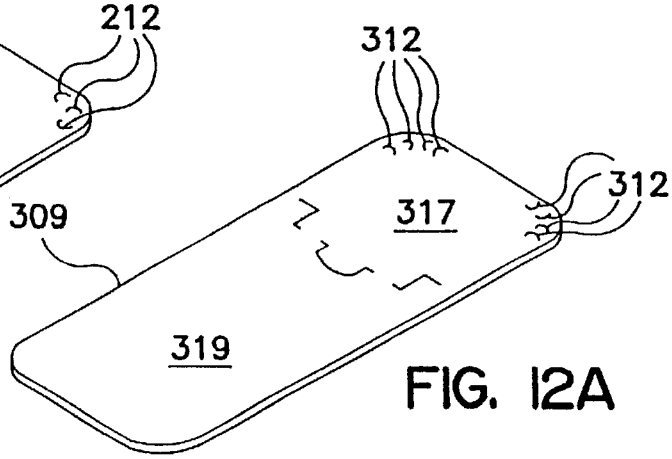
FIG. 12*a* is a perspective view of a blank used to form another alternative lid.
Figure 11B:
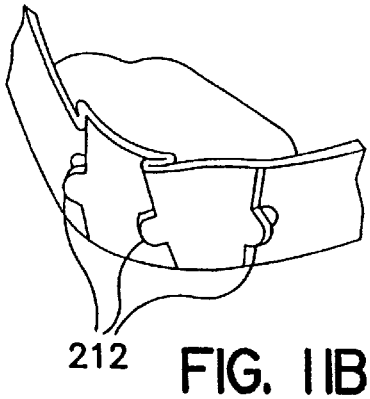
FIG. 11*b* is a perspective view of FIG. 11*a*, showing the teeth provided for enhancing friction upon articulation and prior to positioning the container in its sealed orientation.
Figure 12B:
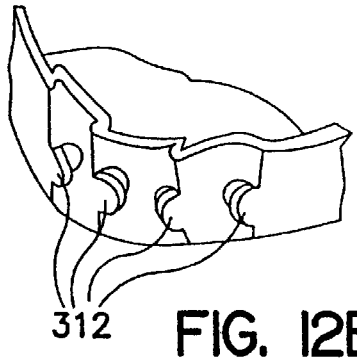
FIG. 12*b* is a perspective view of FIG. 12*a*, showing the teeth provided for enhancing friction upon articulation and prior to positioning the container in its sealed orientation.

A line of weakness or cut 135 (FIG. 7) extends around the forward portion of the container body 103. Rather than having vertical slices at the ends of the cut 135, as shown in FIGS. 1 and 2, the cut 135 has a sloped end (FIG. 7). The sloped end of the slice connects with the cuts 123 of the cover line 121. Thus, when the cover member 109 is assembled into the body 103 to produce the container 101, the cover front portion 117 can be opened. The cover front portion 117 is substantially the same, and operates in substantially the same manner, as the cover front portion 17 of container 1. However, the cover 109 has the tab 130 that engages the membrane or seal 137 when the cover front portion 117 is opened, as shown in FIG. 10. The engagement of the tab 130 with the seal 137 will create a further frictional engagement between the lid and the membrane that will help maintain the cover in its opened position.

The third and fourth embodiments of the cover member are shown in FIGS. 11*a*–12*b*. The tube or body (not shown) associated with the cover member 209 and 309 of FIGS. 11*a* and 12*a* may be substantially identical in construction to body 3 of container 1 of FIGS. 1–2. The cover member 209 and 309, in turn, is substantially similar to the cover member 109. A hinge region separates the cover front portion 217 and 317 from the cover back portion 219 and 319. The hinge region includes opposing outer cuts 223 and 323 that have outer ends spaced from the side edges of the cover member 209 and 309 and extend inwardly slightly. A second pair of opposing cuts 225 and 325 extend rearwardly (and orthogonally) from outer cuts 223 and 323. A pair of inner fold lines 227 and 327 extends inwardly from the ends of the opposing cuts 225 and 325. Another pair of opposing cuts 228 and 328 extend rearwardly (and orthogonally) from the inner fold lines 227 and 327 and together with arcuate cuts 229 and 329, form tab 230 and 330. The tab 230 and 330 is formed to extend toward the cover rear portion 219 and 319.

The substantial difference lies in the peripheral edges of cover front portion 217 and 317. Cover front portion 217 and 317 includes equidistantly spaced teeth 212 and 312 (FIGS. 11*b* and 12*b*) on its peripheral edges. Engagement of protruding teeth 212 and 312, which may be completely cut through the cover or partially cut from the cover's back surface, with the tube body portion (not shown) creates a further frictional engagement between the lid and the membrane that will help maintain cover member 209 and 309 in its closed position. Teeth 212 and 312 may vary in shape, but are, preferably, rounded or pointed.

Figure 13:
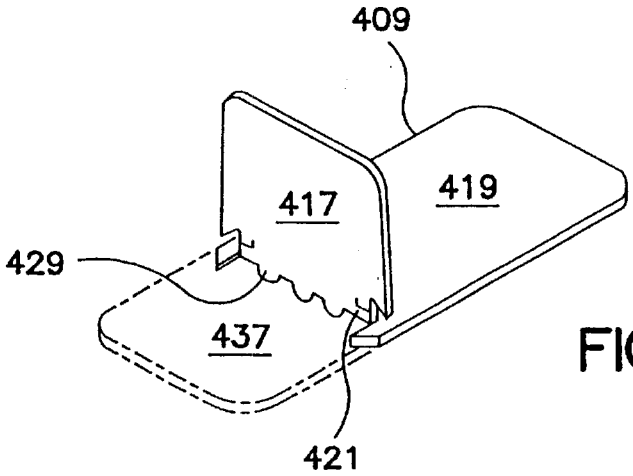
FIG. 13 is a perspective view of a blank used to form yet another alternative lid, with the lid being open.

A fifth embodiment of the cover member is shown in FIG. 13. The tube or body (not shown) associated with FIG. 13 may be substantially identical in construction to body 3 of container 1 of FIGS. 1–2. The cover member 409, in turn, is substantially similar to cover member 109. The substantial difference lies in line 421 that separates the cover front portion 417 from the cover back portion 419. Line 421 includes three equidistantly spaced tabs or detentes 429. Tab 429 are formed to extend toward the cover back portion 419. To form each of tabs 429, a partial cut, in a semi-circular shape, is formed by making partial cuts on the bottom side of cover back portion 419. The engagement of tabs 429 with the seal 437 creates a further frictional engagement between the lid and the membrane that will help maintain the cover member 409 in its opened position.

Figure 14A:
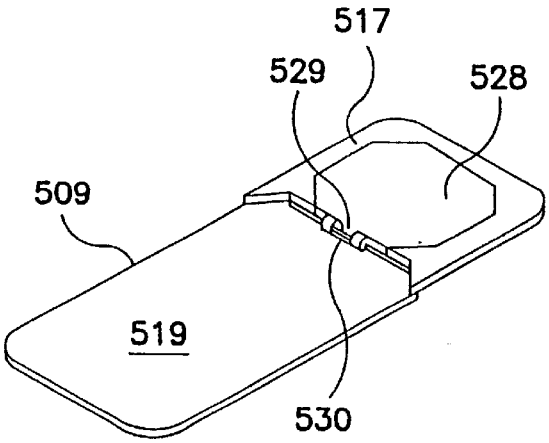
FIG. 14*a* is a perspective view of a blank used to form an alternative lid, with the lid being closed.
Figure 14B:
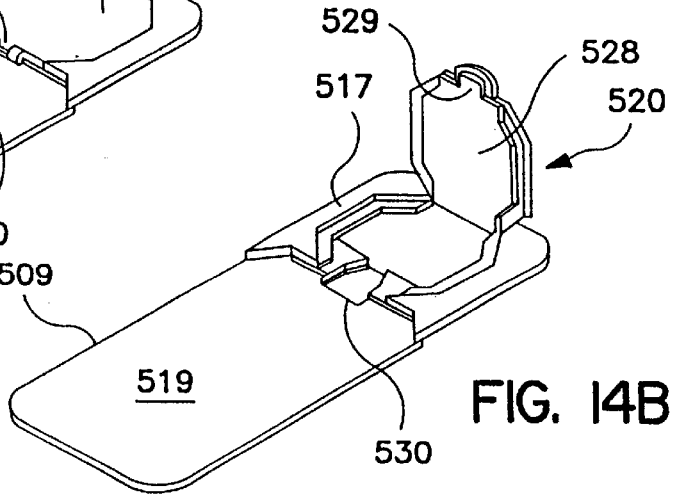
FIG. 14*b* is a perspective view of a blank used to form an alternative lid, with the lid being open.

A sixth embodiment of the cover member is shown in FIGS. 14*a* and 14*b*. The tube or body (not shown) associated with FIGS. 14*a* and 14*b* may be substantially identical in construction to the body 3 of container 1 of FIGS. 1–2. The cover front portion 517, preferably a z-folded single layer of material, includes closure assembly 520 (FIG. 14*b*), which comprises an octagonally shaped closure 528, tab 529 and slot 530. To secure cover member 509, closure 528 is inserted into slot 530 until tab 529 is in contact with cover back portion 519 (FIG. 14*a*). To maintain cover member 509 in its substantially open, dispensing orientation, closure 528 is manually biased to a position substantially perpendicular to the cover member axis (FIG. 14*b*). Although closure 528 is illustrated as octagonally shaped, it is likewise contemplated that it may be circular, rectangular, square or any other geometric shape.

Figure 15A:
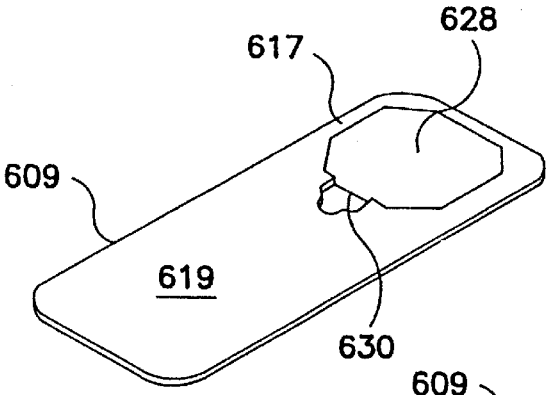
FIG. 15*a* is a perspective view of a blank used to form another alternative lid, with the lid being closed.
Figure 15B:
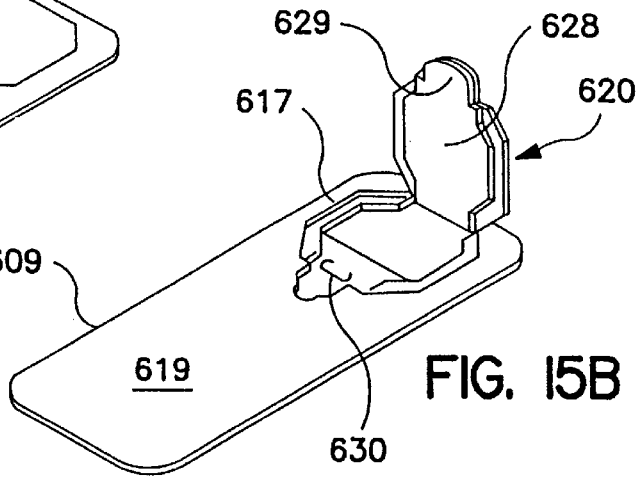
FIG. 15*b* is a perspective view of a blank used to form another alternative lid, with the lid being open.

A seventh embodiment of the cover member is shown in FIGS. 15*a* and 15*b*. The tube or body (not shown) associated with FIGS. 15*a* and 15*b* may be substantially identical in construction to the body 3 of container 1 of FIGS. 1–2. The cover front portion 617, preferably made from two separate pieces, includes closure assembly 620, which comprises an octagonal-shaped closure 628, tab 629 and slot 630. To secure cover member 609, tab 629 is inserted in slot 630 10 until closure 628 is in contact with cover front portion 617 (FIG. 15*a*). Although closure 628 is illustrated as octagonally-shaped, it is likewise contemplated that it may be circular, rectangular, square or any other geometric shape.

An eighth embodiment of the cover member is shown in FIGS. 16*a*–*f*. The tube or body (not shown) associated with FIGS. 16*a*–f may be substantially identical in construction to the body 3 of container 1 of FIGS. 1–2. Cover member 709 includes support member 740 (FIG. 16*d*), housing member 742 (FIG. 16*e*) and closure member 744 (FIG. 16*f*). Support member 740 is, preferably, substantially rectangular and includes aperture 746 (FIG. 16*d*). Aperture 746 is also, preferably, substantially rectangular and is positioned on the front end of support member 740.

As shown in FIG. 16*e*, housing member 742 includes body portion 748, first side panel 750 and second side panel 752. Body portion 748 includes aperture 754 (FIG. 16*b*) and sealing member 756, which substantially covers aperture 754 (FIG. 16*a*) prior to detachment of sealing member 756 from body portion 748. Preferably, sealing member 756 is smaller than aperture 754. Sealing member 756 also includes tab member 758. Upon engagement of tab member 758 and subsequent removal of sealing member 756, closure member 744 is exposed.

As shown in FIG. 16*f*, closure member 744 includes front portion 760 and back portion 762. Front portion 760 includes aperture 764, which allows the user to engage closure member 744 for opening and closing cover member 709. Preferably, closure member 744 is substantially rectangular and sized so as to be capable of slidable movement, within housing member 742, from a substantially closed orientation to a substantially open, dispensing orientation and back to the substantially closed orientation.

In operation, closure member 744 is folded, with front portion 760 adjacent back portion 762. Closure member 744 is then positioned adjacent housing member 742, so that aperture 754 is positioned overlying aperture 764. First side panel 750 and second side panel 752 are then wrapped around closure member 744 and secured to one another. Preferably, the first and second side panels are configured so as not to cover aperture 754. Upon securement, first and second side panels abut the left, right and bottom sides of aperture 754 along the perimeter of aperture 754.

Housing member 742 is secured to support member 740, with aperture 746 and aperture 754 being coincident. The outer edges of support member 740 are positioned coincident fold line 745 of housing member 742. When so positioned, aperture 754 is entirely within aperture 746. When in the substantially closed orientation, a portion of aperture 764 abuts the top edge of aperture 746. To dispense products contained within the container, sealing member 756 is removed and aperture 764 is engaged and retracted toward the back end of support member 740 until a portion of aperture 746 abuts the bottom edge of aperture 746. To reclose the container, aperture 746 is moved toward the front end of support member 740 until a portion of aperture 764 abuts the top edge of aperture 746.

A ninth embodiment of the cover member is shown in FIGS. 17*a*–*f*. The tube or body (not shown) associated with 17*a*–f may be substantially identical in construction to the body 3 of container 1 of FIGS. 1–2. Cover member 709' is substantially identical in construction to cover member 709 shown in FIGS. 16*a*–*c*. As shown in FIG. 17*f*, front portion 760' of closure member 744' further includes tab member 766, which, upon engagement, allows the user to move cover member 709' from its substantially closed orientation to its substantially open, dispensing orientation and back to its substantially closed orientation.

Cover member 709' includes support member 740' (FIG. 17*d*), housing member 742' (FIG. 17*e*) and closure member 744' (FIG. 17*f*). Support member 740' is, preferably, substantially rectangular and includes aperture 746' (FIG. 17*d*). Aperture 746' is also, preferably, substantially rectangular and is positioned on the front end of support member 740'.

As shown in FIG. 17*e*, member 742' includes body portion 748', first side panel 750' and second side panel 752'. Body portion 748' includes aperture 754' (FIG. 17*b*) and sealing member 756', which substantially covers aperture 754' (FIG. 17*a*) prior to detachment of sealing member 756' from body portion 748'. Preferably, sealing member 756' is smaller than aperture 754'. Sealing member 756' also includes tab member 758'. Upon engagement of tab member 758' and subsequent removal of sealing member 756', closure member 744' is exposed.

As shown in FIG. 17*f*, closure member 744' includes front portion 760' and back portion 762'. Front portion 760' includes aperture 764', which allows the user to engage tab member 766 for opening and closing cover member 709'. Preferably, closure member 744' is substantially rectangular and sized so as to be capable of slidable movement, within housing member 742', from a substantially closed to a substantially closed to a substantially open, dispensing orientation and back to the substantially closed orientation.

In operation, closure member 744' is folded, with front portion 760 adjacent back portion 762'. Closure member 744' is then positioned adjacent housing member 742', so that aperture 754' is positioned overlying aperture 764'. First side panel 750' and second side panel 752' are then wrapped around closure member 744' and secured to the back side of housing member 742'.

Preferably, the first and second side panels are configured so as not to cover aperture 754'. Upon securement to the back side of housing member 742', first and second side panels abut the left and right sides of aperture 754' along the perimeter of 754'.

Housing member 742' is secured to support member 740', with aperture 746' and aperture 754' being coincident. The outer edges of support member 740' are positioned coincident fold line 745' of housing member 742'. When so positioned, aperture 754' is entirely within aperture 746'. When in the substantially closed orientation, a portion of tab member 766 abuts the top edge of aperture 746'. To dispense products contained within the container, sealing member 756' is removed and tab member 766 is engaged and retracted toward the back end of support member 740' until a portion of tab member 766 abuts the bottom edge of aperture 746'. To reclose the container, tab member 766 is moved towards the front end of support member 740' until a portion of tab member 766 abuts the top edge of aperture 746'.

Figure 18D:
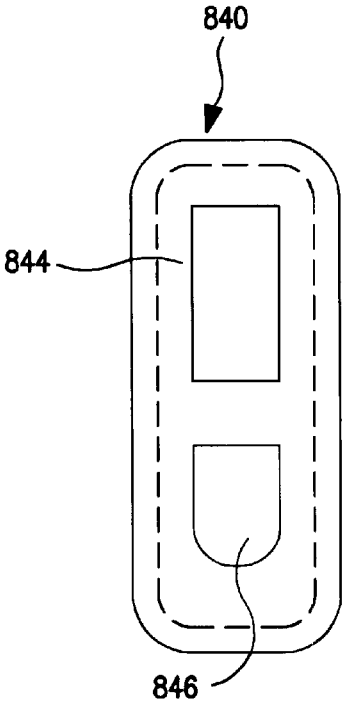
FIG. 18*d* is a top, plan view of a first blank used to form the alternative lid of FIGS. 18*a* and 18*b;*
Figure 18E:
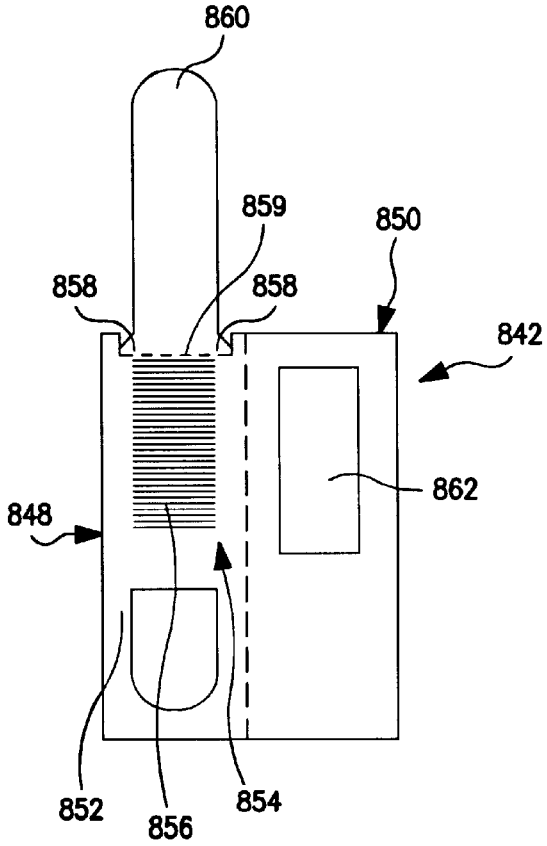
FIG. 18*e* is a top, plan view of a second blank used to form the alternative lid of FIGS. 18*a* and 18*b;*

Yet another embodiment of the cover member is shown in FIGS. 18*a*–18*e*. The tube or body (not shown) associated with FIGS. 18*a*–*e* may be substantially identical in construction to the body 3 of container 1 of FIGS. 1–2. Cover member 809 includes support member 840 (FIG. 18*d*) and closure member 842 (FIG. 18*e*). Support member 840 further includes first aperture 844 and second aperture 846. Preferably, the first and second apertures are substantially quadrilateral and rectangular, respectively, but they may vary in size and shape. For example, it is likewise contemplated that they may be circular, square or any other geometric shape.

Closure member 842 includes front portion 848 and back portion 850. Front portion 848 includes body portion 852 and slider portion 854. As shown in FIG. 18*e*, slider portion 854 includes slider member 856, protrusions 858, fold line 859 and tongue 860. Back portion 850 includes aperture 862 (FIG. 18*e*). Preferably, aperture 862 is substantially quadrilateral, but it may vary in size and shape.

In operation, closure member 842 is folded, with front portion 848 adjacent back portion 850. Slider member 856 is then folded at fold line 859, with tongue 860 being adjacent the bottom end of slider portion 854. Closure member 842 is then positioned adjacent support member 840, so that first aperture 844 is positioned overlying aperture 862. The outer edges of aperture 862 are positioned coincident first aperture 844. To dispense products contained within the container, and as shown in FIG. 18*b*, tongue 860 is engaged and retracted toward the back end of support member 840 until protrusions 858 come in contact with slider portion 854 to prevent tongue 860 from extending beyond the bottom portion of slider portion 854. To reclose the container, tongue 860 can be slidably moved toward the front end of support member 840 until slider member 856 covers first aperture 844.

Upon engagement of tongue 860 cover member 809 can be retracted to its substantially open, dispensing orientation. Tongue 860 also can be slidably moved, within closure member 842, to position cover member 809 back in its substantially closed orientation.

An eleventh embodiment of the cover member is shown in FIGS. 19*a*–*e*. The tube or body (not shown) associated with FIGS. 19*a*–*e* may be substantially identical in construction to the body 3 of container 1 of FIGS. 1–2. Cover member 909 includes support member 940 (FIG. 19*d*), closure member 942 (FIG. 19*e*), and twist lid 950 (FIG. 19*f*). Support member 940 includes aperture 944 that, preferably, is circular. Aperture 944 also is, preferably, positioned on the front end of support member 940.

Figure 19D:
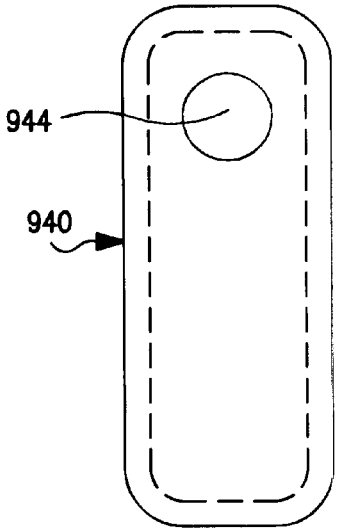
FIG. 19*d* is a top, plan view of a first blank used to form the alternative lid of FIGS. 19*a* and 19*b;*
Figure 19E:
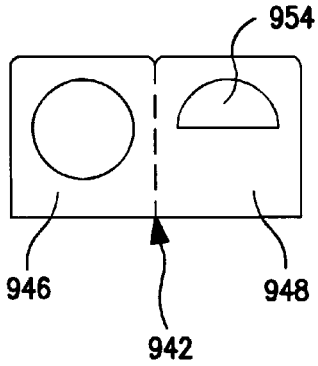
FIG. 19*e* is a top, plan view of a second blank used to form the alternative lid of FIGS. 19*a* and 19*b;*
Figure 19F:
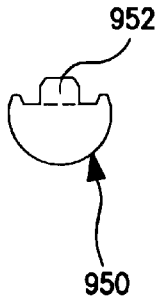
FIG. 19*f* is a top, plan view of a third blank used to form the alternative lid of FIGS. 19*a* and 19*b;*

As shown in FIG. 19*e*, closure member 942 includes front portion 946, back portion 948, twist lid 950 and tab 952. Preferably, twist lid 950 (FIG. 19*f*) is configured to be approximately one half the size of aperture 944. Back portion 948 includes aperture 954, which also, preferably, is approximately half the size of aperture 944. Preferably, twist lid 950 and aperture 944 are substantially identical in size, but are positioned 180° offset from one another in the substantially open, dispensing orientation. Twist lid 950 is slidingly inserted between support member 940 and closure member 942 to allow twist lid 950 to rotate within the range of 0° to 180°. Upon rotation of twist lid 950 180°, twist lid 950 and aperture 944 are coincident, so as to substantially seal cover member 909. To expose the contents therein, tab 952 can be rotated within the range of 0°-180°. Preferably, tab 952 is rotated 180° prior to dispensing the container contents (FIG. 19*b*).

Figure 20A:
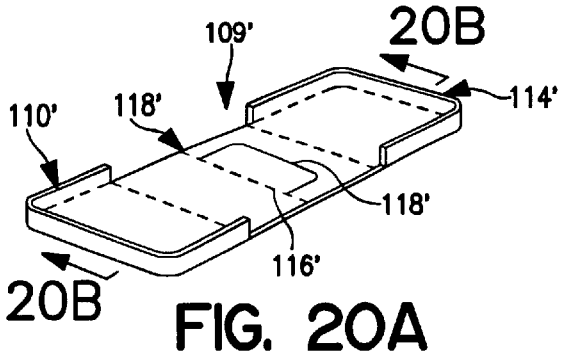
FIG. 20*a* is a perspective view of an alternative lid, with the lid being closed.
Figure 20B:
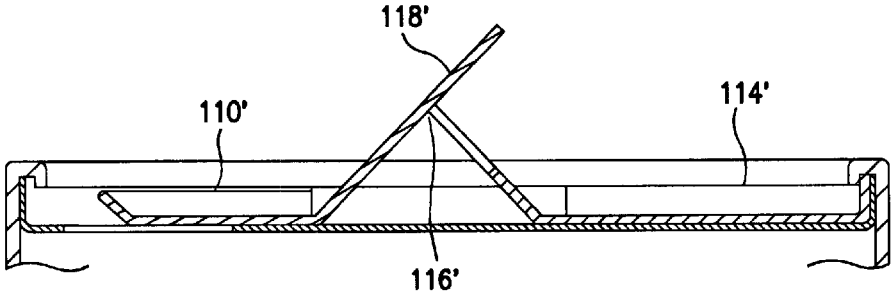
FIG. 20*b* is a cross-sectional view taken along lines 20*b*—20*b* of FIG. 20*a*, looking in the direction of the arrows, with the lid being partially opened.

A twelfth embodiment of the cover member is shown in FIGS. 20*a* and 20*b*. The tube or body (not shown) associated with FIGS. 20*a* and 20*b* may be substantially identical in construction to the body 3 of container 1 of FIGS. 1–2. As shown in FIG. 20*a*, cover member 109' includes first portion 110', second portion 112', and third portion 114'. Preferably, first portion 110' and third portion 114' are substantially similar.

As shown in FIG. 20*b*, second portion 112' includes fold line 116' and tab member 118'. Preferably, third portion 114' is adhered to body 3 of container 1. Upon engagement of tab member 118', first portion 110' moves along cover member

109' toward third portion 114' to expose an open area to dispense product (FIG. 20*b*).

Figure 21A:
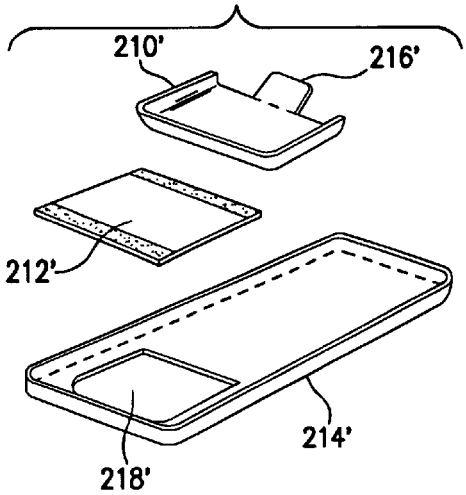
FIG. 21*a* is a perspective, exploded view of the blanks used to form an alternative lid.
Figure 21B:
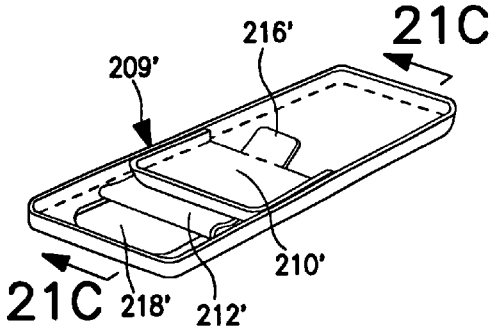
FIG. 21*b* is a perspective view of the fully assembled lid of FIG. 21*a*, with he lid being partially opened.

A thirteenth embodiment of the cover member is shown in FIGS. 21*a a*–21*c*. The tube or body (not shown) associated with FIGS. 21*a*–21*c* may be substantially identical in construction to the body 3 of container 1 of FIGS. 1–2. As shown in FIG. 21*a*, cover member 209' includes slide lid portion 210', membrane 212' and full lid portion 214'. Slide lid portion 210' further includes tab member 216' and full lid portion 214' further includes aperture 218'.

Figure 21C:
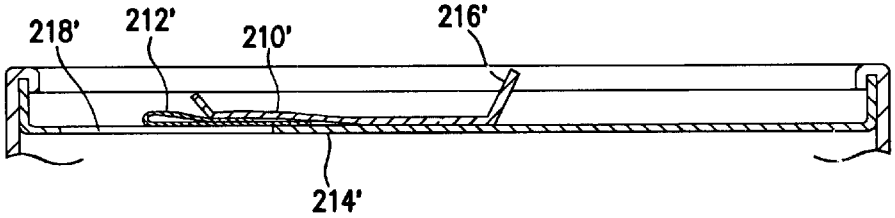
FIG. 21*c* is a cross-sectional view taken along lines 21*c*—21*c* of FIG. 21*b*, and looking in the direction of the arrows.

As shown in FIG. 21*c*, a portion of membrane 212', or an additional membrane, is adhered to the bottom of slide lid portion 210' and another portion of membrane 212' is adhered to full lid portion 214'. Membrane 212' overlays aperture 218'. Upon engagement of tab member 216', slide lid portion 210' moves away from the aperture 218' (FIG. 21b) and membrane 212' peels back from full lid portion 214', exposing aperture 218'. In the dispensing orientation, a portion of membrane 212', or an additional membrane, remains adhered to full lid portion 214'. To reclose the container, tab member 216' is slid toward aperture 218'

Figure 22B:
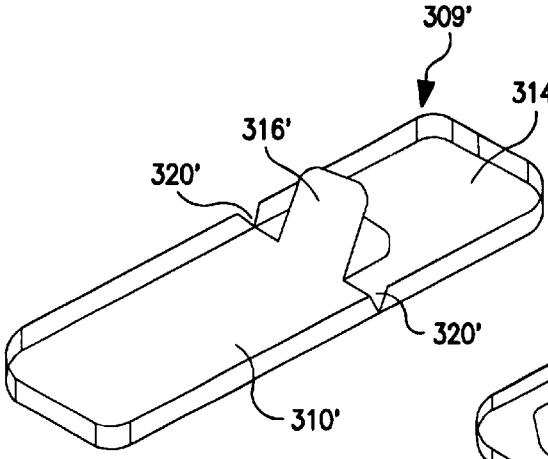
FIG. 22*b* is a perspective view of the fully assembled lid of FIG. 22*a*, with the lid being closed and the pull tab in the up position.
Figure 22C:
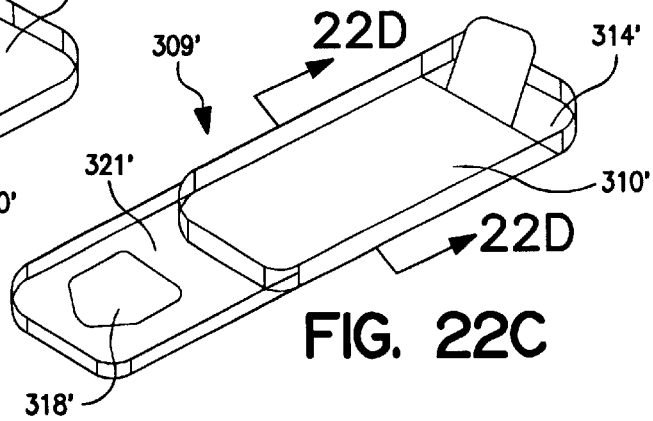
FIG. 22*c* is a perspective view of the fully assembled lid of FIG. 22*a*, with the lid being opened.
Figure 22A:
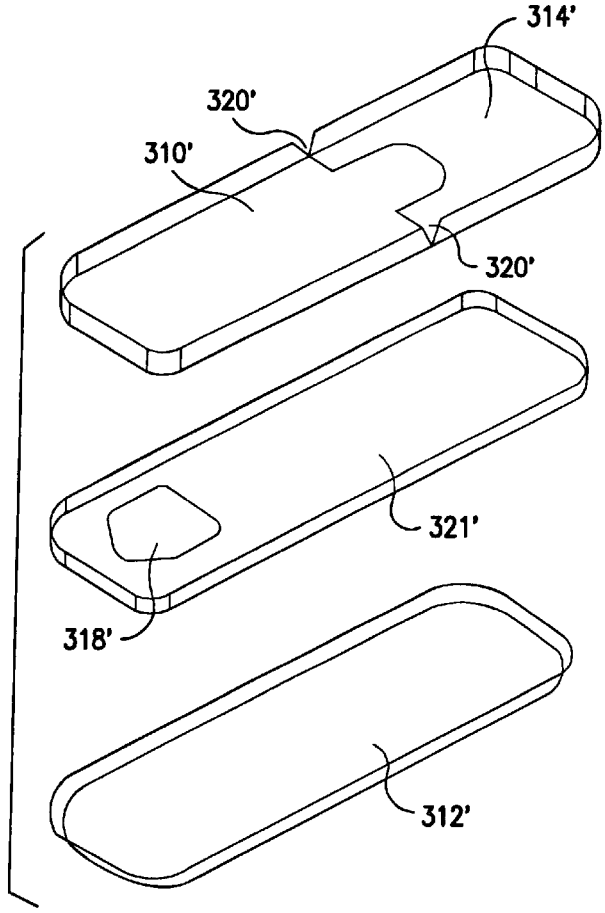
FIG. 22*a* is a perspective, exploded view of the blanks used to form an alternative lid.

A fourteenth embodiment of the cover member is shown in FIGS. 22*a*–22*d*. The tube or body (not shown) associated with FIGS. 22*a*–22*d* may be substantially identical in construction to the body 3 of container 1 of FIGS. 1–2. As shown in FIG. 22*a*, cover member 309' includes slide lid portion 310', support member 321', membrane 312' and full lid portion 314'. Slide lid portion 310' further includes tab member 316'.

Figure 22D:
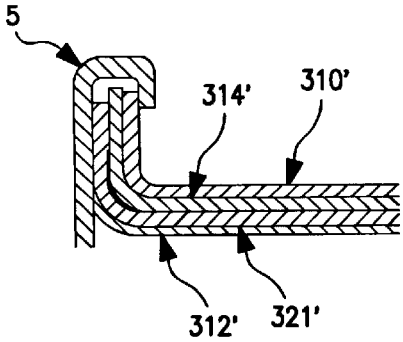
FIG. 22*d* is a cross-sectional view taken along lines 22*d*—22*d* of FIG. 22*c*, and looking in the direction of the arrows, showing the lid in its open position.

Membrane 312' may be adhered to the bottom of slide lid portion 310' and full lid portion 314'. Slide lid portion 310' overlies aperture 318' in support member 321'. Tab member 316' is lifted up and out of its closed position to break its perforations and to separate cover member 309 into two pieces. Slide lid portion 310' is then pulled toward full lid portion 314' to expose membrane 312'. Membrane 312' may then be broken to enable consumers to dispense a product from the container. Notches or cut-outs 320' allow the edges of slide lid portion 310' to move in a linear relationship inside the edges of full lid portion 314'. As shown in FIG. 22*d*, top edge 5 of container 3 is configured to curl inward and down around portions of membrane 312', portions of full lid portion 314' and portions of slide lid portion 310'.

The foregoing description and drawings merely explain and illustrate the invention, and the invention is not limited thereto except insofar as the pending claims are so limited as those skilled in the art who have the disclosure before them will be able to make modifications and variations therein without departing from the scope of the invention.

What is claimed is:

1. A paperboard container for releasably dispensing contents contained therein, the container being convertible from a substantially sealed orientation to a substantially open, dispensing orientation and back to the substantially sealed orientation, the paperboard container comprising:

a substantially tubular body member having an upper edge defining an upper opening;

a bottom affixed to the body member;

a top member substantially corresponding in shape to the shape of the upper opening, the top member having a lid panel extending across at least a portion of the upper opening of the tubular body, a support member mounted to the lid panel, a paperboard closure member connected to and movable relative to at least one of the lid panel and the support member, an outer edge having a peripheral shape, the peripheral shape being larger than the peripheral shape of each of the upper edge and the upper opening of the container member, the top member being telescopically received within the upper opening of the container member, with the upper edge of the container member being rolled up over the outer edge of the top member to seal the top member to the paperboard container;

the closure member oriented substantially completely above the support member;

the closure member being movable from a sealed position to a open position in a plane substantially parallel to the lid panel; and the top member being repositionable to the sealed orientation to substantially reseal the container member.

2. The invention according to claim 1 wherein the container includes a membrane adhered to inner surfaces of the container member below the container top member.

3. The container according to claim 1 wherein the closure member moves from the first position to the second position in a substantially linear direction.

4. The container according to claim 3 wherein the lid panel extends substantially across the length of the upper opening of the tubular body and has an aperture extending therethrough, the closure member including a panel having a length substantially less than the length of the upper opening, and is positioned atop the lid panel and operably configured to slide therealong, from the sealed position over the aperture, to the open position longitudinally displaced relative thereto, and the support member being a flexible elongated tongue connected at one end thereof to an end of the closure member, and at another end thereof, to the lid panel, such that the support member rolls upon itself, as the closure member is moved from the sealed position to the open position.

5. The container according to claim 3 wherein the lid panel has an aperture, the closure member substantially covering the lid panel aperture in its substantially closed orientation.

6. The container according to claim 3 wherein the closure member has an aperture, the closure member aperture allowing the container to be moved from the substantially sealed orientation to the substantially open, dispensing orientation and back to the substantially sealed orientation.

7. The container of claim 3 wherein the support member includes an aperture, the support member aperture being coincident with the lid panel aperture upon attachment of the support member to the lid panel.

8. The container according to claim 3 wherein the closure member includes a tab member for positioning the closure member between the substantially sealed orientation and the substantially open, dispensing orientation.

9. The container according to claim 3 wherein the closure member as a tongue and at least one protrusion, the tongue being capable of positioning the closure member between the substantially sealed orientation and the substantially open, dispensing orientation, the at least one protrusion restricting movement of the closure member within the support member.

10. The container according to claim 1 wherein the closure member pivots about an axis substantially perpendicular to the lid panel axis.

11. The container according to claim 10 wherein the closure member includes a twist lid for pivoting the closure member between the substantially sealed orientation and the substantially open, dispensing orientation.

12. The container according to claim 10 wherein the twist lid is semi-circular.

13. A paperboard container for releasably dispensing contents contained therein, the container being convertible from a substantially sealed orientation to a substantially open, dispensing orientation and back to the substantially sealed orientation, the paperboard container comprising:

a substantially tubular body member having an upper edge defining an upper opening;

a bottom affixed to the body member;

a top member substantially corresponding in shape to the shape of the upper opening, the top member having a support member, a stationary lid portion, a paperboard slide lid portion movable relative to at least one of the support member and the stationary lid portion, a membrane mounted to the support member, an outer edge having a peripheral shape, the peripheral shape being larger than the peripheral shape of each of the upper edge and the upper opening of the container member, the top member being telescopically received within the upper opening of the container member, with the upper edge of the container member being rolled up over the outer edge of the top member to seal the top member to the paperboard container;

the slide lid portion oriented substantially completely above the support member;

the slide lid portion being movable from a sealed position to a open position in a plane substantially parallel to the stationary lid portion;

the slide lid portion, in moving from a sealed position to a open position slides on top of, and outside the stationary lid portion; and the top member being repositionable to the sealed orientation to substantially reseal the container member.

* * * * *